US007779506B2

(12) United States Patent
Kang et al.

(10) Patent No.: US 7,779,506 B2
(45) **Date of Patent: *Aug. 24, 2010**

(54) VACUUM CLEANER

(75) Inventors: Sung Su Kang, Changwon-si (KR); Jae Duck Jung, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1304 days.

This patent is subject to a terminal disclaimer.

(21) Appl. No.: 10/944,186

(22) Filed: Sep. 20, 2004

(65) Prior Publication Data

US 2005/0198767 A1 Sep. 15, 2005

(30) Foreign Application Priority Data

Mar. 11, 2004 (JP) ..... 10-2004-0016480
Mar. 11, 2004 (KR) ..... 10-2004-0016479
Mar. 11, 2004 (KR) ..... 10-2004-0016482

(51) Int. Cl.
*A47L 9/10* (2006.01)
*A47L 9/16* (2006.01)

(52) U.S. Cl. ..... 15/353; 15/359; 15/327.1

(58) Field of Classification Search ..... 15/353, 15/347, 327.1, 327.7, 359; 55/DIG. 3, 429, 55/426

See application file for complete search history.

(56) References Cited

U.S. PATENT DOCUMENTS 6,171,356 B1 * 1/2001 Twerdun ..... 55/337
6,192,550 B1 2/2001 Hamada et al. ..... 15/352
6,434,785 B1 8/2002 Vandenbelt et al. ..... 15/344
6,436,160 B1 8/2002 Stephens et al. ..... 55/337
6,579,334 B2 6/2003 Oh et al. ..... 55/426
6,810,557 B2 11/2004 Hansen et al. ..... 15/353
6,818,032 B2 11/2004 Bilek et al. ..... 55/337

(Continued)

FOREIGN PATENT DOCUMENTS

JP 2003-339596 A 12/2003

(Continued)

OTHER PUBLICATIONS

Korean Office Action dated May 27, 2009 for Application No. 10-2004-0024413.

(Continued)

*Primary Examiner*—Lee D Wilson
(74) *Attorney, Agent, or Firm*—KED & Associates LLP

(57) ABSTRACT

A vacuum cleaner is provided that including suction device that provides suction force, a suction nozzle that draws air by the suction force provided from the suction device, a dust collecting box that cleans and discharges the air drawn through the suction nozzle, the dust collecting box having an opening in an upper surface thereof, a filter assembly including an upper holding part selectively fastened to an edge of the opening, the upper holding part having an air discharge hole at a central portion thereof, a lower holding part spaced a distance downward from the upper holding part, and a filter between the upper holding part and the lower holding part that filters dust from air, the filter having a discharge passage therein, and a lower cover that selectively opens/closes a lower portion of the dust collecting box. This structure permits easy cleaning and replacement of the dust collector assembly in a vacuum cleaner.

19 Claims, 8 Drawing Sheets

U.S. PATENT DOCUMENTS

| | | | | |
|---|---|---|---|---|
| 6,994,739 | B2 * | 2/2006 | Park | 55/337 |
| 7,052,523 | B2 | 5/2006 | Murphy et al. | 55/330 |
| 7,086,119 | B2 * | 8/2006 | Go et al. | 15/353 |
| 7,207,083 | B2 | 4/2007 | Hayashi et al. | 15/347 |
| 7,669,282 | B2 | 3/2010 | Jung et al. | |
| 2003/0066156 | A1 | 4/2003 | Yang | |
| 2003/0131441 | A1 * | 7/2003 | Murphy et al. | 15/350 |
| 2005/0198767 | A1 * | 9/2005 | Kang et al. | 15/353 |
| 2005/0198768 | A1 * | 9/2005 | Jung et al. | 15/353 |
| 2005/0198769 | A1 * | 9/2005 | Lee et al. | 15/353 |
| 2005/0198770 | A1 * | 9/2005 | Jung et al. | 15/353 |
| 2005/0198771 | A1 * | 9/2005 | Min et al. | 15/353 |

FOREIGN PATENT DOCUMENTS

| | | | |
|---|---|---|---|
| JP | 2004-33241 | | 2/2004 |
| KR | 10-2000-0039238 | A | 7/2000 |
| KR | 10-2003-0030296 | | 4/2003 |
| KR | 10-2003-0030297 | | 4/2003 |
| KR | 10-0445470 | B | 8/2004 |
| KR | 10-0487938 | B | 4/2005 |
| KR | 10-0540439 | B | 12/2005 |
| KR | 10-0572882 | | 4/2006 |

OTHER PUBLICATIONS

Korean Office Action dated May 27, 2009 for Application No. 10-2004-0016480.
Korean Office Action dated May 29, 2009 for Application No. 10-2004-0016482.
Korean Office Action dated May 29, 2009 for Application No. 10-2004-0016489.
Korean Office Action dated May 29, 2009 for Application No. 10-2004-0016490.
Korean Office Action dated May 29, 2009 for Application No. 10-2004-0016492.
Korean Notice of Allowance Dated Dec. 17, 2009.
U.S. Office Action issued in U.S. Appl. No. 11/006,785 dated May 14, 2010.
Korean Office Action dated May 29, 2009.

* cited by examiner

VACUUM CLEANER

CROSS-REFERENCE TO RELATED APPLICATIONS

This application claims the benefit of Korean Application Nos. P2004-16479, P2004-16480, and P2004-16482, three of which were filed on Mar. 11, 2004, and are hereby incorporated by reference as if fully set forth herein.

BACKGROUND OF THE INVENTION

1. Field of the Invention

The present invention relates to vacuum cleaners, and more particularly, to a vacuum cleaner having an improved dust collector assembly.

2. Description of the Related Art

In general, the vacuum cleaner draws dust-laden air from a floor of a room, removes the dust from the air, and discharges only the air again.

FIG. 1 illustrates a perspective view of a related art vacuum cleaner. As shown, the vacuum cleaner is provided with a body 1, and a suction nozzle 2.

The body 1 has a suction means mounted therein for drawing room air. Air is drawn from the floor to the body 1 through the suction nozzle 1 by a suction force generated at the body 1.

The body 1 has a lower body 5 and an upper body 6. The lower body 5 has the suction means mounted therein, and the upper body 6 has electric components mounted therein for controlling the vacuum cleaner. The body 1 has wheels 8 secured to opposite sides of a lower portion thereof, and the wheel 8 has an outlet 8*a* for discharging air having foreign matters removed from the air drawn through the suction nozzle 2.

Between the body 1 and the suction nozzle 2, there are a suction hose 3*b*, an operation part 4, and an extension tube 3*a*. The suction hose 3*b* is formed of a flexible material, and the operation part 4 is at an end of the suction hose 3*b*. The extension tube 3*a* makes the suction hose 3*b* and the suction nozzle 2 in communication.

Upon application of power through a power line, the vacuum cleaner is at a standby condition. If a user operates the operation part 4, an appropriate suction force is generated at the suction means in the body. The suction force is transmitted to the suction nozzle 2 through the suction hose 3*b*, the operation part 4, and the extension tube 3*a* in succession.

According to this, dust-laden air is drawn through the suction nozzle 2. The dust is separated from the air at a dust collecting box 10, to discharge only the air through the outlet 8*a*. By repeating this process, cleaning of the floor is performed.

However, the related art vacuum cleaner has the following problems.

First, the related art vacuum cleaner has a structure of the dust collecting box difficult to clean, to require much time, or to have inconvenience in cleaning the dust collecting box after finish of the operation.

Second, dismounting of the filter from an inside of the vacuum cleaner is not easy, to cause difficulty in replacement and cleaning of the filter.

SUMMARY OF THE INVENTION

Accordingly, the present invention is directed to a vacuum cleaner that substantially obviates one or more problems due to limitations and disadvantages of the related art.

An object of the present invention is to provide a vacuum cleaner having a dust collector assembly which is easy to replace and clean.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a vacuum cleaner includes suction means for providing suction force, a suction nozzle for drawing room air by the suction force provided from the suction means, a dust collecting box for cleaning, and discharging the room air drawn through the suction nozzle, the dust collecting box having an opening in an upper surface thereof, a filter assembly including an upper holding part selectively fastened to an edge of the opening, the upper holding part having an air discharge hole at a central portion thereof, a lower holding part spaced a distance downward from the upper holding part, and a filter between the upper holding part and the lower holding part for filtering dust from air, the filter having a discharge passage therein, and a lower cover for opening/closing a lower portion of the dust collecting box, selectively.

The vacuum cleaner further includes a projection piece projected from one side of the upper holding part in a radial direction, and a lever provided to an upper surface of the dust collecting box for rotating around a hinge to fasten the projection piece, selectively. The dust collecting box includes a downwardly recessed loading portion at one side of the upper surface, for accommodating the projection piece and the lever. The upper holding part includes hand grips projected upward from the upper surface thereof.

In the meantime, the vacuum cleaner further includes a separation plate for dividing an inside space of the dust collecting box into an upper space and a lower space. The separation plate has a hole at one side thereof for separating dust particles with relatively large masses to downward.

The separation plate has an upper surface in contact with an under side of the filter assembly. The separation plate is fixed to a top of a supporting member projected upward from the lower cover.

Preferably, the supporting member is formed as one unit with the lower cover. The separation plate has an outside diameter smaller than an inside diameter of the dust collecting box. The dust collecting box includes a partition plate between the separation plate and the lower cover for preventing air from circulating.

The lower cover rotates around a cover hinge at a lower portion of the dust collecting box, and selectively fastened by a locking assembly. The locking assembly includes a projection from the lower cover, a hinge shaft provided to a holding part projected from a side surface of the dust collecting box, a hook portion rotatably mounted on the hinge shaft for hooking the projection selectively, a button portion provided to a side opposite to the hook portion with reference to the hinge shaft, and a spring for providing an elastic force pressing the button portion to one side.

The dust collecting box includes a suction guide provided to an outside surface thereof obliquely for guiding drawn air in a tangential direction. The dust collecting box includes a hand grip on an outside surface thereof.

The vacuum cleaner further includes a liquid sprayer provided to an inside surface of the dust collecting box, having a spray button on a top thereof connected to a press button passed through an upper surface of the dust collecting box. The upper surface of the dust collecting box can be opened/closed.

In another aspect of the present invention, a vacuum cleaner includes suction means provided to an inside of a body of the vacuum cleaner for providing suction force, a suction nozzle for drawing room air by the suction force provided from the suction means, a dust collecting box for cleaning, and discharging the room air drawn through the suction nozzle, the dust collecting box having an opening in an upper surface thereof, a filter assembly including an upper holding part selectively fastened to an upper surface of an edge of the opening, the upper holding part having an air discharge hole at a central portion thereof, a lower holding part spaced a distance downward from the upper holding part, and a cylindrical filter between the upper holding part and the lower holding part, the filter having a discharge passage therein, and a lower cover mounted to be rotatable around a cover hinge provided to a lower portion of the dust collecting box for opening/closing the lower portion of the dust collecting box selectively, a separation plate mounted to divide an inside space of the dust collecting box into an upper space and a lower space, the separation plate having a hole at one side thereof, and a partition plate between the separation plate and the lower cover, for prevention of circulation of the air drawn thereto.

In another aspect of the present invention, a vacuum cleaner includes suction means for providing suction force, a suction nozzle for drawing room air by the suction force provided from the suction means, a dust collecting box for cleaning, and discharging the room air drawn through the suction nozzle, the dust collecting box having an opening in an upper surface thereof, a filter assembly selectively fastened to an edge of the opening, for filtering dust from the drawn air, and discharging upward, and a lower cover for opening/closing a lower portion of the dust collecting box, selectively.

In further aspect of the present invention, a vacuum cleaner includes suction means provided to an inside of a body of the vacuum cleaner for providing suction force, a suction nozzle for drawing room air by the suction force provided from the suction means, a dust collecting box for cleaning, and discharging the room air drawn through the suction nozzle, the dust collecting box having an opening in an upper surface thereof, a filter assembly fastened to an edge of the opening selectively, for filtering dust from drawn air, and discharging upward, a lower cover mounted to be rotatable around a cover hinge provided to a lower portion of the dust collecting box, a separation plate mounted over, and as one unit with the lower cover to divide an inside space of the dust collecting box into an upper space and a lower space, the separation plate having a diameter smaller than an inside diameter of the dust collecting box, and a partition plate between the separation plate and the lower cover, for prevention of circulation of the air drawn thereto.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

A vacuum cleaner in accordance with each of the embodiments of the present invention will be described with reference to FIGS. 2~8.

In the vacuum cleaners, there are canister type and upright type of vacuum cleaners. The canister type of vacuum cleaner has a suction nozzle and a body provided separately and connected with a connection tube. Opposite to this, the upright type of vacuum cleaner has the suction nozzle and the body provided as one unit.

The following embodiments are applicable all types of vacuum cleaners including the canister type and the upright type of vacuum cleaners.

Figure 1:
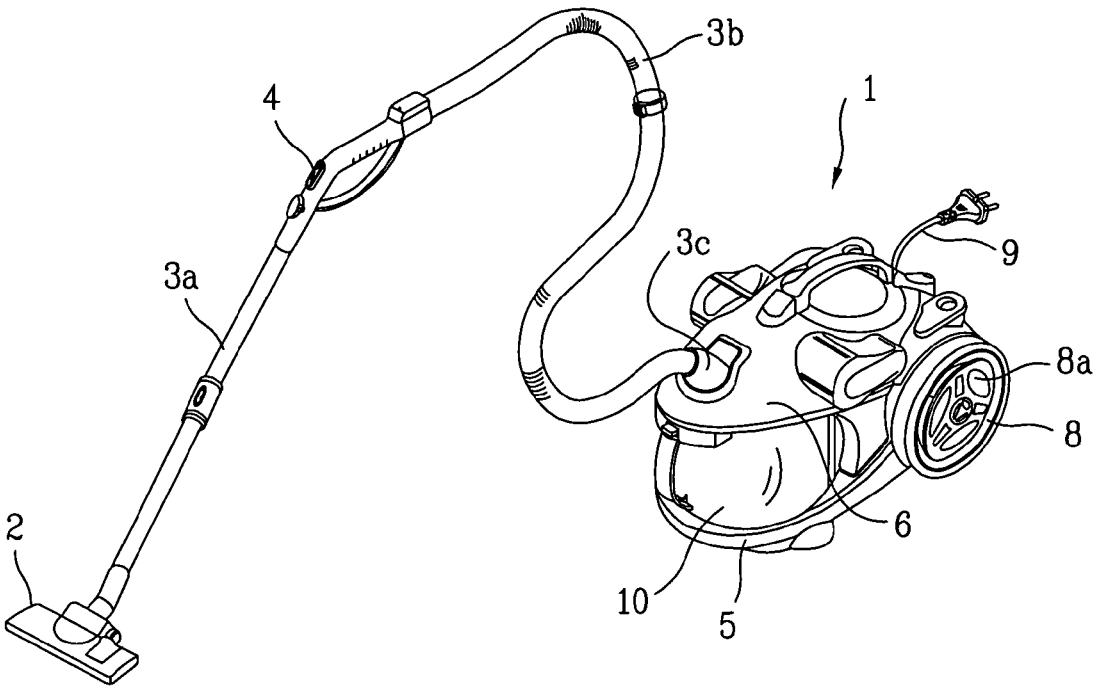
FIG. 1 illustrates an outside perspective view of a related art vacuum cleaner.
Figure 2:
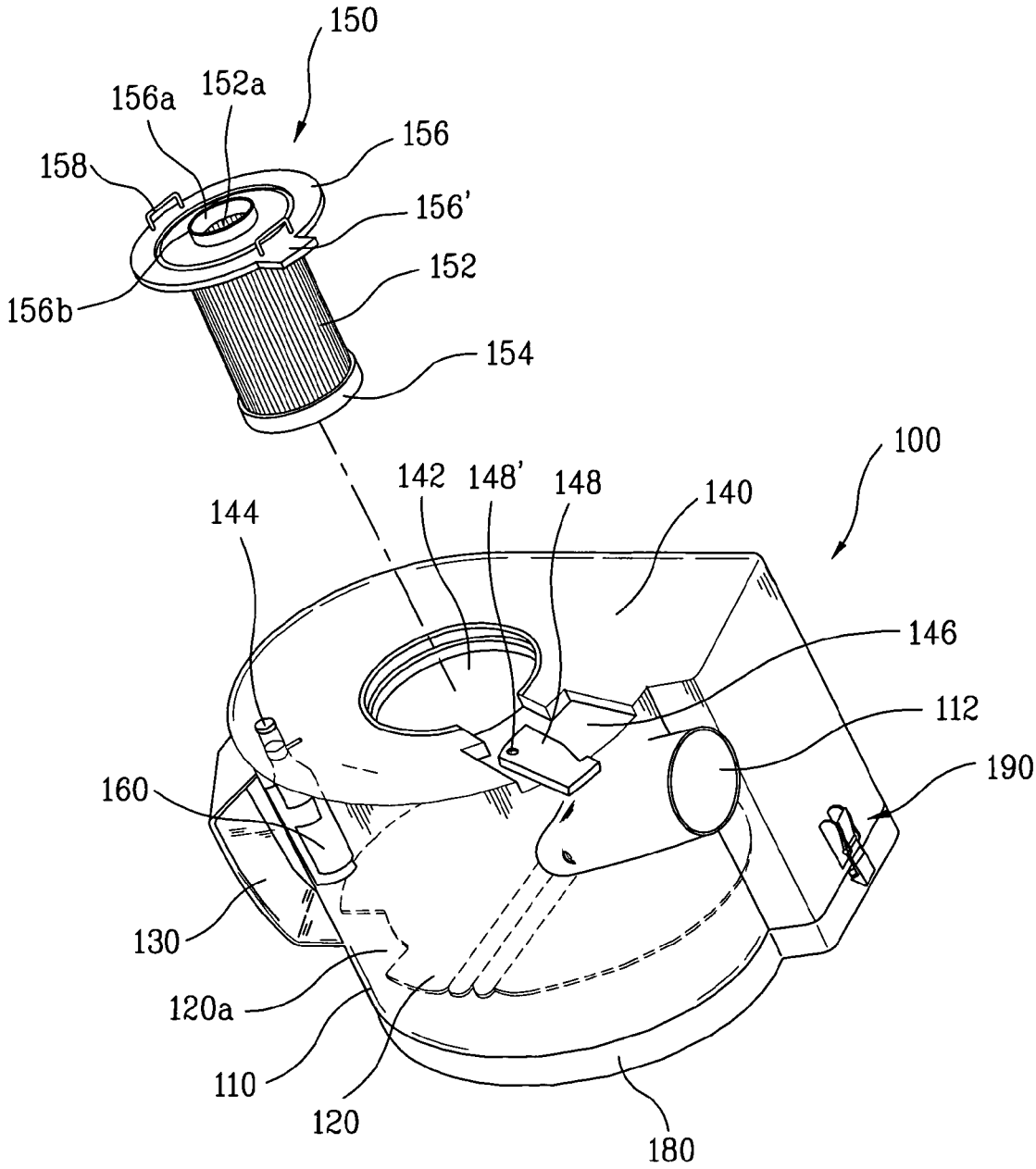
FIG. 2 illustrates a disassembled perspective view of a dust collector assembly in a vacuum cleaner in accordance with a preferred embodiment of the present invention.

FIG. 2 illustrates a disassembled perspective view of a dust collector assembly in a vacuum cleaner in accordance with a preferred embodiment of the present invention.

Referring to FIG. 2, the dust collector assembly 100 includes a dust collecting box 110, a filter assembly 150, and a lower cover 180.

The body of the vacuum cleaner has suction means mounted therein for providing a suction force, and room air is drawn into the dust collector assembly 100 through the suction nozzle by the suction force.

The dust collecting box 110 is cylindrical substantially, and has a suction guide 112 at a side thereof for guiding the air drawn thereto. The suction guide 112 has one end projected obliquely from an outside surface of the dust collecting box 110, for drawing air through the suction guide 112 in a tangential direction along an inside surface of the dust collecting box 110.

The dust collecting box 110 has a separation plate 120 mounted on an inside surface thereof for dividing an inside space of the dust collecting box 110 into an upper space and a lower space, and the separation plate 120 has a hole 120*a* at one side of the separation plate. Dust particles with relatively large masses in the air passes through the hole 120*a*, and drop downward below the separation plate 120.

For easy mounting/dismounting to/from the body, the dust collecting box 110 has a hand grip 130 at an outside surface of the dust collecting box 110.

There is an opening 142 at a central portion of an upper surface of the dust collecting box 110, for securing the filter assembly 150 to an edge of the opening 142.

The filter assembly 150 has an upper holding part 156, a lower holding part 154, and a filter 152. The upper holding part 156 is a circular plate with an air discharge hole 156*a* at a central portion thereof, fitted to an upper surface of an edge of the opening 142. For this, the edge of the opening 142 has a step for fitting to the upper holding part 156.

The lower holding part 154 is spaced a distance from the upper holding part 156 downwardly. The cylindrical filter 152 is provided between the upper holding part 156 and the lower holding part 154. The filter 152 has an air discharge passage 152*a* therein.

The upper holding part 156 has a diameter relatively greater than the lower holding part 154. Accordingly, the lower holding part 154 and the filter 152 can be inserted through the opening 142, more easily.

The air discharge hole 156*a* at a central portion of the upper holding part 156 discharges the air guided through the air discharge passage 152*a*. The air discharge hole 156*a* has a discharge guide 156*b* projected upward from a circumference thereof, so that the discharge hole 156*a* can be connected to the outlet in the body of the vacuum cleaner, easily.

The lower holding part 154 is in contact with an upper surface of the separation plate 120. According to this, since the lower holding part 154 has an underside supported on the separation plate 120, the lower holding part is held, more securely.

In the meantime, the dust collecting box 110 has a loading portion 146 at one side thereof recessed downwardly. The loading part 146 has fastening means for fastening the filter assembly 150 to the dust collecting box 110, selectively.

Referring to FIG. 2, the fastening means includes a projection piece 156' and a lever 148. The projection piece 156' is projected in a radial direction from one side of the upper holding part 156. The lever 148 fastens the projection piece 156' selectively as the lever 148 rotates around the hinge 148' mounted on an upper surface of the dust collecting box 110. Accordingly, in a state the projection piece 156' is fastened by the lever 148, separation of the filter assembly 150 is prevented.

The upper holding part 156 has a hand grip 158 on an upper surface for easy drawing of the filter assembly 150 from the dust collecting box 110. As shown, one pair of hand grips 158 are formed on opposite sides of the discharge hole 156*a*.

After rotating the lever 148 to release the projection piece 156', if the hand grip 158 is pulled upward, the filter assembly 150 is separated from the opening 142 of the dust collecting box 110.

Opposite to this, at the time of securing the filter assembly 150, the filter assembly 150 is inserted in the opening 142, and the lever 148 is rotated, when the projection piece 156' is fastened by the lever 148.

In the meantime, for filtering dust from air, the filter 152 is provided between the holding parts 154, and 156. The filter 152 is formed of an endurable and washable fibrous plastic. It is preferable that the filter 152 is formed of polyester. Moreover, by forming a plurality of folds in a length direction of the filter 152, a contact area with air is increased to improve a dust collecting capability.

A mesh filter may further be provided to an outside of the filter 152, or a plurality of filters may be provided in multiple layers.

The discharge passage 152*a* is inside of the filter 152, such that the air passed through the filter 152 flows upward along the discharge passage 152*a* until the air is discharged through the discharge hole 156*a*.

For maintaining the cylindrical filter 152 between the holding parts 154 and 156, it is preferable that means for connecting the upper and lower holding parts 154, and 156, and supporting the filter 152 is required. The supporting means may be a plurality of ribs connected between the holding parts or a cylindrical member having a plurality of holes.

In the meantime, there is a liquid sprayer 160 at one side of an inside of the dust collecting box 110. The liquid sprayer 160 includes a body 162, a spray button 164, and a spray nozzle 166.

Liquid is stored in the cylindrical body 162. The spray nozzle 166 is on an upper portion of the body 162, and a spray button 164 is provided to a top of the body 162. Upon pushing the spray button 164, the liquid is sprayed through the spray nozzle 166. The sprayed liquid increases humidity of an inside of the dust collecting box, to prevent static electricity. The liquid has insecticide, germicide, aromatic agent, or the like added thereto.

The upper surface 140 of the dust collecting box has a press button 144 in the vicinity of an edge thereof in contact with the spray button 164. Therefore, upon pressing the press button 144, the spray button is pressed simultaneously, and the liquid is sprayed through the spray nozzle 166.

The liquid sprayer 160 is mounted on a mounting part 170 on an inside of the dust collecting box 110. The mounting part 170 includes an attachment portion 172, a supporting plate 174, and holders 176.

The attachment portion 172 is attached to the inside surface of the dust collecting box 110, and the supporting plate 174 is on an underside of the attachment portion 172 for supporting an underside of the liquid sprayer 160. The holders 176 are respectively extended forward from opposite sides of a substantially middle portion of the attachment part 172, and have elasticity. The holders 176 are curved to surround the body 162, for receiving and holding the body 162 therebetween by an elastic deformation.

That is, upon pushing in the liquid sprayer 160, the holders 176 move a certain distance away from each other, to receive and hold the liquid sprayer 160 on an inside thereof.

Figure 3:
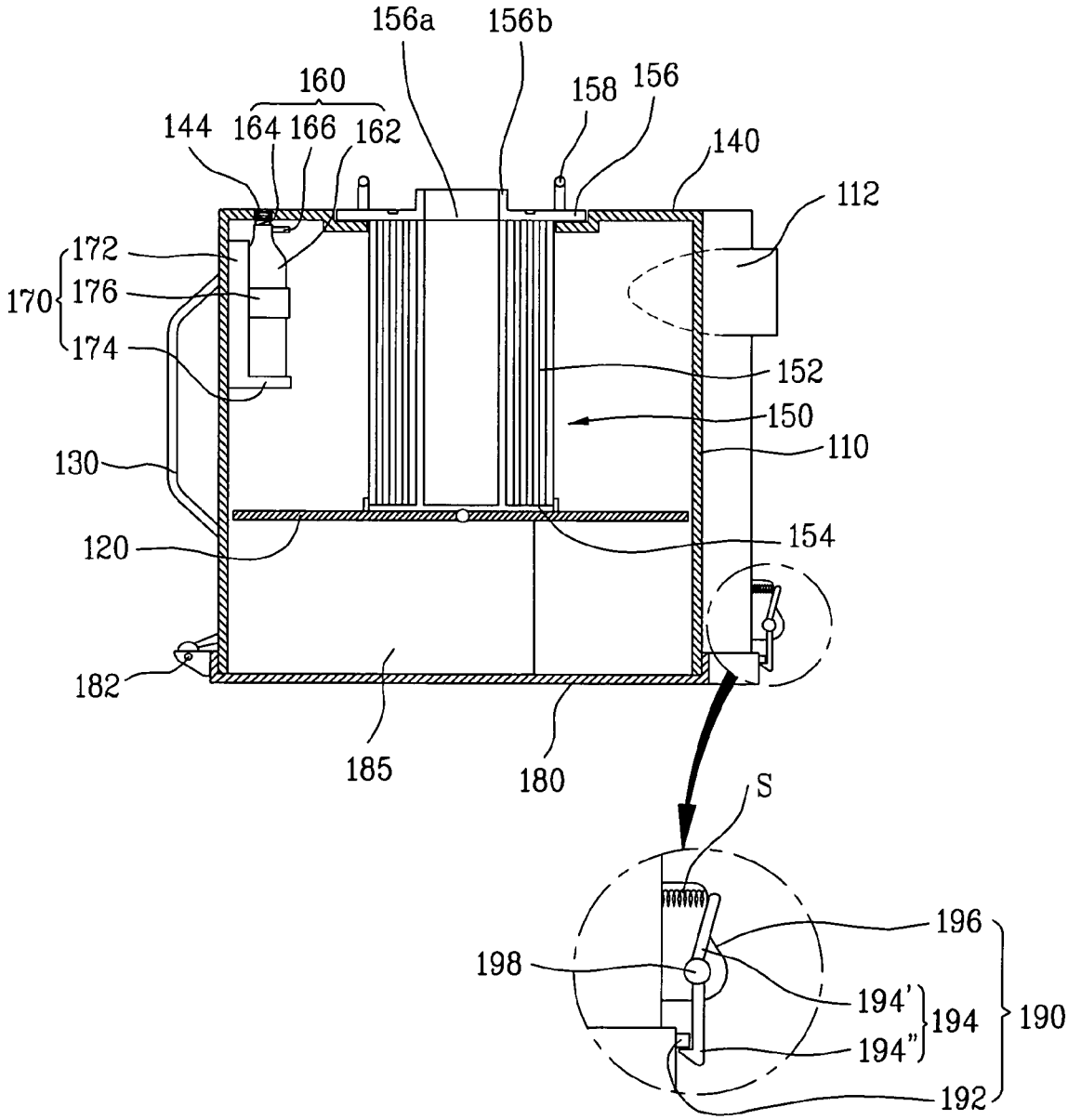
FIG. 3 illustrates a side section of the dust collector assembly in FIG. 2.

FIG. 3 illustrates a section of a dust collector assembly in a vacuum cleaner in accordance with a preferred embodiment of the present invention.

Referring to FIG. 3, a bottom of the dust collecting box 110 is opened, and the opened bottom is opened/closed with a lower cover 180, selectively. The lower cover 180 rotates around a cover hinge 182 provided to a lower portion of the dust collecting box 110. There is a locking assembly at an opposite side of the cover hinge 182 for fastening the lower cover 180, selectively.

The locking assembly includes a projection 192, a hinge shaft 198, a rotatable hook 194, and a spring 'S'. The projection 192 is projected from the lower cover 180, and the hinge shaft 198 is provided to a holding part 196 projected from an outside surface of the dust collecting box 110. The rotatable hook 194 makes seesaw movement around the hinge shaft 198.

The rotatable hook 194 includes a hook portion 194" for hooking the projection 192 selectively, and a button portion 194'. The spring 'S' is between the button portion 194' and the outside surface of the dust collecting box 110. When the button portion 194' is pressed, the hook portion 194" rotates in a clockwise direction, and the projection 192 is released from an engaged state. Opposite to this, if no force is applied to the button portion 194', the button portion 194' rotates in an anti-clockwise direction by the spring 'S'.

In the meantime, the projection may be formed on the outside surface of the dust collecting box 110, while the rotatable hook 192 is formed on the lower cover 180.

In the meantime, a partition plate 185 is provided between the lower cover 180 and the separation plate 120, for, not only supporting the separation plate 120, but also prevention of circulation of air drawn below the separation plate 120, thereby preventing the dust from flying.

The operation of the dust collector assembly in the vacuum cleaner in accordance with a preferred embodiment of the present invention will be described.

The dust-laden air drawn through the suction nozzle is introduced into an inside of the dust collecting box 110 through the suction guide 112.

In this instance, dust particles with relatively large masses drop down below the separation plate 120, and dust particles with relatively small masses are separated by the filter during the dust particles flow together with air, and accumulated on an inside of the dust collecting box 110. The air passed through the filter 152 is discharged through the discharge hole 156*a* via the discharge passage 152*a*.

In this instance, upon pressing the press button 144 on the upper cover 140 of the dust collecting box, the spray button 164 on the liquid sprayer 160 is pressed simultaneously, to spray the liquid toward an inner portion of the dust collecting box 110 through the spray nozzle 166.

In the meantime, when it is intended to remove the dust accumulated under the separation plate, the lower cover 180 is opened.

Figure 4:
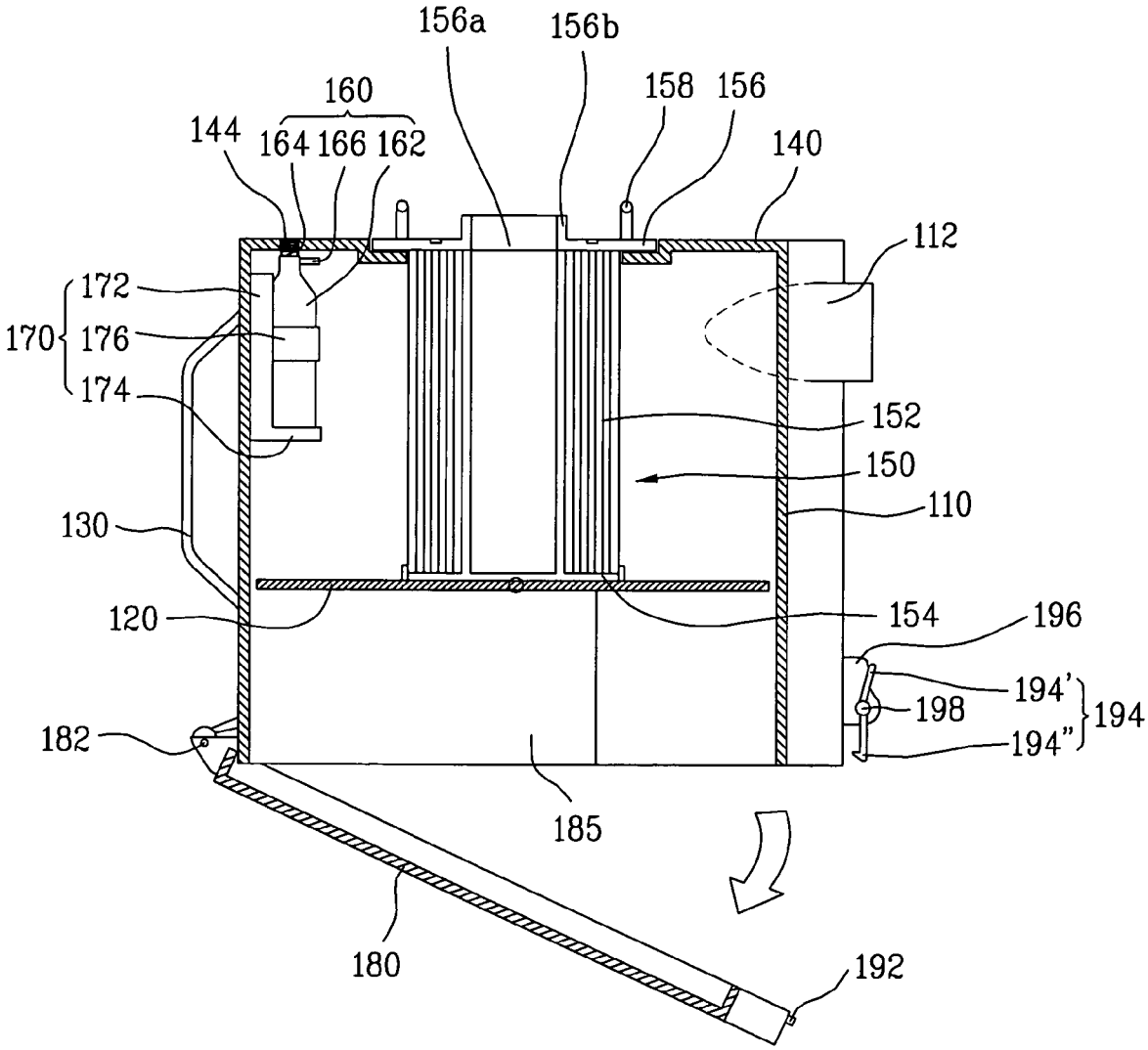
FIG. 4 illustrates a side section of the dust collector assembly in FIG. 2 in a state a lower cover thereof is opened.

FIG. 4 illustrates a section of a dust collector assembly in a state a lower cover thereof is opened.

Referring to FIG. 4, upon pressing the button portion 194' of the locking assembly, the projection 192 is released from the hook portion 194. Then, the lower cover 180 rotates around the cover hinge 182, until the lower cover 180 is fully opened, thereby permitting the user to clean an inside of the dust collecting box 110, easily.

Opposite to this, when it is intended to close the lower portion of the dust collecting box 110, what is required is pressing the lower cover 180 stronger than compression force of the spring 'S'. For this, one side of the hook portion 194" to be brought into contact with the projection 192 is sloped, for the projection 192 to slide along the sloped surface until the projection 192 is hooked at the hook portion 194".

Figure 5:
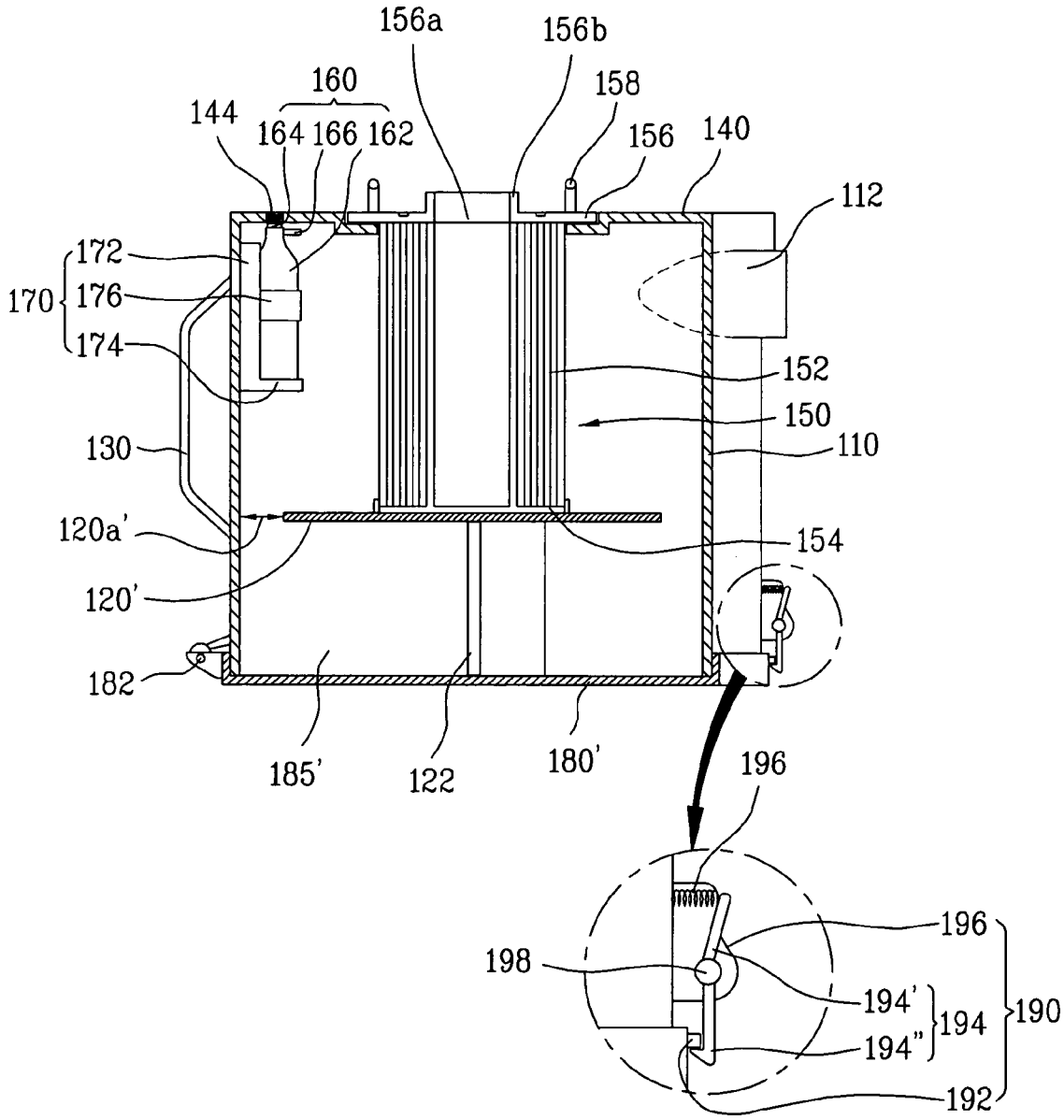
FIG. 5 illustrates a side section of a dust collector assembly in a vacuum cleaner in accordance with other preferred embodiment of the present invention.
Figure 6:
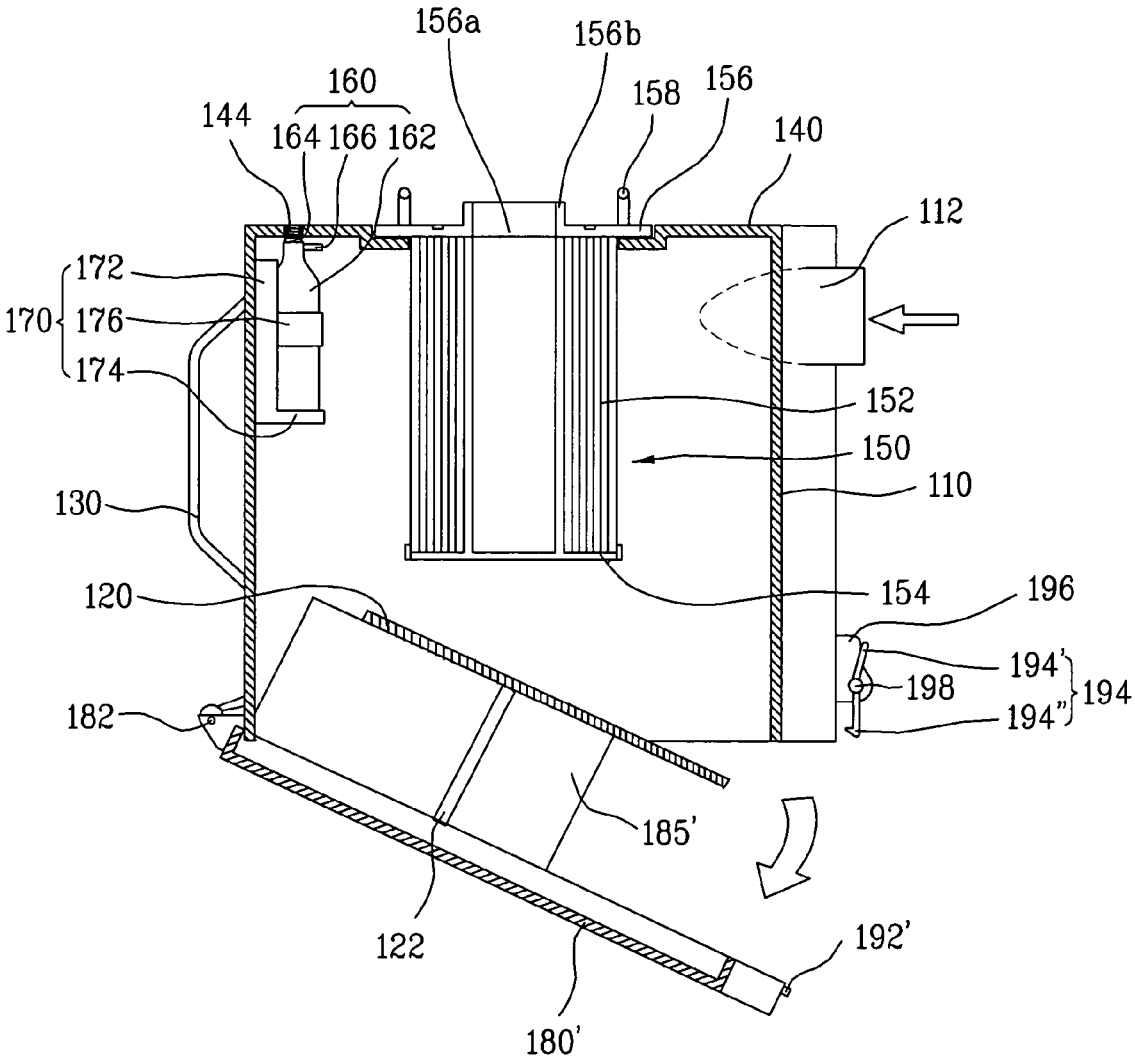
FIG. 6 illustrates a side section of the dust collector assembly in FIG. 5 in a state a lower cover thereof is opened.

In the meantime, FIG. 5 illustrates a section of a dust collector assembly in a vacuum cleaner in accordance with other preferred embodiment of the present invention, and FIG. 6 illustrates a side section of the dust collector assembly in FIG. 5 in a state a lower cover and a separation plate thereof are opened.

Referring to FIG. 5, a filter assembly is detachably mounted on the opening in an upper surface of a dust collecting box. Bottom of the dust collecting box is opened, and opened/closed by a lower cover.

The dust collecting box 110 includes a separation plate 120' over, and fixed to the lower cover 180' for dividing an inside space of the dust collecting box 110 into an upper space and a lower space. Therefore, the separation plate 120' rotates around the cover hinge 182 together with the lower cover 180'. It is preferable that the lower cover 180' is formed as one unit with the separation plate 120'.

Referring to FIG. 6, since the lower cover 180' and the separation plate 120' are opened together, the user can clean an inside of the dust collector assembly, easily. That is, all the upper, and lower spaces of the separation plate 120' can be cleaned.

In the meantime, the separation plate 120' has an outside diameter smaller than an inside diameter of the dust collecting box 110, to form a gap 120*a'* between the separation plate 120' and an inside surface of the dust collecting box 110, through which dust particles with comparatively large masses drop downward below the separation plate 102' through the gap 120*a'*.

Figure 7:
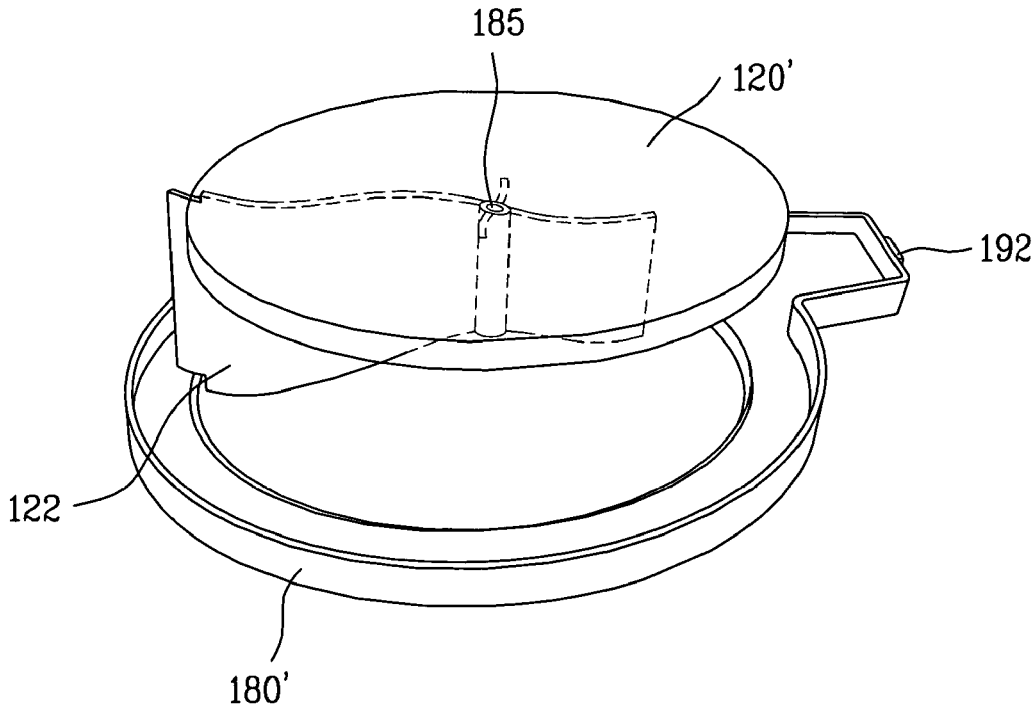
FIG. 7 illustrates a perspective view of a lower cover fixed to a separation plate in accordance with other preferred embodiment of the present invention.

FIG. 7 illustrates a perspective view of a lower cover fixed to a separation plate in accordance with other preferred embodiment of the present invention.

Referring to FIG. 7, for forming a space between the separation plate 120' and the lower cover 180', the separation plate 120' is fixed to a top of a supporting member 122 extended from an upper surface of the lower cover 180'. The supporting member 122 is extended a distance upward from the upper surface of the lower cover 180', and has a cross '+' section when seen from above.

The supporting member 122 has one side joined to a partition plate 185' for prevention of circulation of the air introduced into a lower side of the separation plate 120', for preventing the dust from flying due to the circulation.

Other structures of the dust collector assembly in accordance with other preferred embodiment of the present invention are identical to the preferred embodiment of the present invention, and, therefore, description of which will be omitted.

Figure 8:
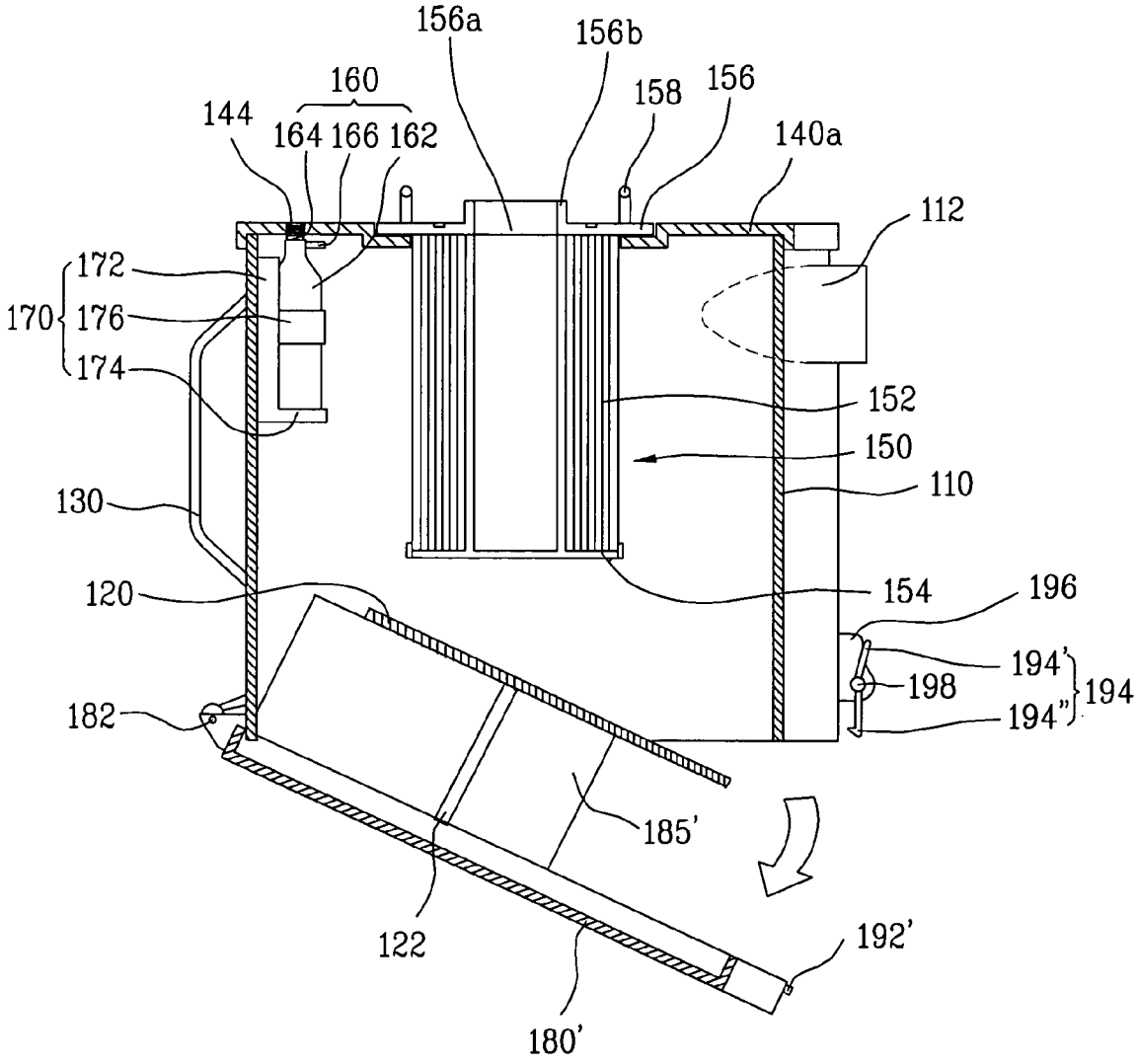
FIG. 8 illustrates a side section of a dust collector assembly in a vacuum cleaner in accordance with another preferred embodiment of the present invention.

FIG. 8 illustrates a side section of a dust collector assembly in a vacuum cleaner in accordance with another preferred embodiment of the present invention.

Referring to FIG. 8, an upper surface of the dust collecting box 110 is covered with an upper cover 140*a*. The upper cover 140*a* opens/closes the upper portion of the dust collecting box 110 selectively, and a filter assembly 150 is detachably mounted on a central portion of the upper cover 140*a*.

According to this, since both an upper portion and a lower portion of the dust collecting box 110 in accordance with another preferred embodiment of the present invention can be opened, the user can clean an inside of the dust collecting box 110, more easily.

As has been described, the dust collector assembly in a vacuum cleaner of the present invention has the following advantages.

First, the detachable provision of the filter assembly to an upper surface of the dust collecting box permits separation of only the filter assembly in an upper direction as required. Therefore, the user can clean the dust collector assembly more easily, and replacement of the filter assembly is easy.

Second, only by pressing a press button, to spray liquid from a liquid sprayer as required, humidity of the vicinity of the filter assembly can be increased, and generation of static electricity at an inside of the duct collecting container can be prevented.

Third, the lower portion of the dust collecting box can be opened/closed with the lower cover, selectively. Therefore, dust inside of the dust collecting box can be cleaned easily through the lower portion of the dust collecting box. In a case both the lower cover and the separation plate are opened together, an upper space and a lower space of the separation plate can be cleaned at the same time.

Fourth, as the air discharge hole of the dust collecting box is formed in the upper portion thereof, so that the dust drops down by gravity, and the cleaned air is discharged upward, more effective cleaning can be made.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A vacuum cleaner, comprising:

a suction device that provides suction force;

a suction nozzle that draws air into the vacuum cleaner with the suction force provided by the suction device;

a dust collecting box that cleans and discharges the air drawn in through the suction nozzle, the dust collecting box having an opening in an upper cover thereof;

a filter assembly configured to be inserted into the opening in the upper cover of the dust collecting box from a space above the upper cover and withdrawn from the opening in the upper cover of the dust collecting box to the space above the upper cover, and selectively fastened to the upper cover adjacent an edge of the opening, the filter assembly comprising:

an upper holding part configured to be selectively fastened to the edge of the opening, the upper holding part having an air discharge hole at a central portion thereof;

a lower holding part spaced a distance downward from the upper holding part; and a filter between the upper holding part and the lower holding part that filters dust from the air, the filter having a discharge passage therein; and a lower cover that selectively opens and closes a lower portion of the dust collecting box.

2. The vacuum cleaner as claimed in claim 1, further comprising:

a projection piece that projects from one side of the upper holding part in a radial direction; and a lever provided on an upper surface of the dust collecting box configured to rotate around a hinge to selectively fasten the projection piece.

3. The vacuum cleaner as claimed in claim 2, wherein the dust collecting box includes a downwardly recessed loading portion at one side of the upper cover that accommodates the projection piece and the lever.

4. The vacuum cleaner as claimed in claim 1, wherein the upper holding part includes hand grips that project upward from the upper cover thereof.

5. The vacuum cleaner as claimed in claim 1, further comprising a separation plate that divides an inside space of the dust collecting box into an upper space and a lower space.

6. The vacuum cleaner as claimed in claim 5, wherein the separation plate has a hole at one side thereof that separates dust particles from relatively large masses.

7. The vacuum cleaner as claimed in claim 5, wherein the separation plate has an upper surface in contact with an under side of the filter assembly.

8. The vacuum cleaner as claimed in claim 5, wherein the separation plate is fixed to a top of a supporting member that projects upward from the lower cover.

9. The vacuum cleaner as claimed in claim 8, wherein the supporting member is formed as one unit with the lower cover.

10. The vacuum cleaner as claimed in claim 5, wherein the separation plate has an outside diameter smaller than an inside diameter of the dust collecting box.

11. The vacuum cleaner as claimed in claim 5, wherein the dust collecting box includes a partition plate between the separation plate and the lower cover that prevents air from circulating.

12. The vacuum cleaner as claimed in claim 1, wherein the lower cover rotates around a cover hinge at a lower portion of the dust collecting box, and is selectively fastened by a locking assembly.

13. The vacuum cleaner as claimed in claim 12, wherein the locking assembly includes:

a projection that projects from the lower cover;

a hinge shaft provided on a holding part that projects from a side surface of the dust collecting box;

a hook portion rotatably mounted on the hinge shaft that selectively hooks the projection;

a button portion provided on a side opposite to the hook portion with reference to the hinge shaft; and a spring that provides an elastic force that presses the button portion to one side.

14. The vacuum cleaner as claimed in claim 1, wherein the dust collecting box includes a suction guide provided on an outside surface thereof that guides drawn air in a tangential direction.

15. The vacuum cleaner as claimed in claim 1, wherein the dust collecting box includes a hand grip on an outside surface thereof.

16. The vacuum cleaner as claimed in claim 1, further comprising a liquid sprayer provided on an inside surface of the dust collecting box, the liquid sprayer having a spray button on a top thereof connected to a press button passed through an upper surface of the dust collecting box.

17. The vacuum cleaner as claimed in claim 1, wherein the upper cover of the dust collecting box is configured to be opened and closed.

18. A vacuum cleaner, comprising:

a suction device provided inside of a body of the vacuum cleaner that provides suction force;

a suction nozzle that draws air into the vacuum cleaner with the suction force provided by the suction device;

a dust collecting box that cleans and discharges the air drawn through the suction nozzle, the dust collecting box having an opening in an upper cover thereof;

a filter assembly comprising:

an upper holding part configured to be selectively fastened to an upper surface of an edge of the opening, the upper holding part having an air discharge hole at a central portion thereof;

a lower holding part spaced a distance downward from the upper holding part; and a cylindrical filter between the upper holding part and the lower holding part, the filter having a discharge passage therein;

a lower cover mounted to be rotatable around a cover hinge provided on a lower portion of the dust collecting box to selectively open and close the lower portion of the dust collecting box;

a separation plate mounted to divide an inside space of the dust collecting box into an upper space and a lower space, the separation plate having a hole at one side thereof; and a partition plate between the separation plate and the lower cover that prevents circulation of the air drawn thereto, wherein the filter assembly is configured to be inserted into the opening in the upper cover of the dust collecting box from a space above the upper cover and withdrawn from the opening in the upper surface of the dust collecting box to the space above the upper cover.

19. A vacuum cleaner, comprising:

a suction device that provides suction force;

a suction nozzle that draws air into the vacuum cleaner with the suction force provided by the suction device;

a dust collecting box that cleans and discharges the air drawn through the suction nozzle, the dust collecting box having an opening in an upper cover thereof;

a filter assembly configured to be inserted into the opening in the upper cover of the dust collecting box from a space above the upper cover and withdrawn from the opening in the upper cover of the dust collection box to the space above the upper cover and selectively fastened to the upper cover adjacent an edge of the opening, that filters dust from the air and discharges the air in an upward direction; and a lower cover that selectively opens and closes a lower portion of the dust collecting box.

* * * * *